US008792798B2

(12) United States Patent
Inukai et al.

(10) Patent No.: US 8,792,798 B2
(45) Date of Patent: Jul. 29, 2014

(54) IMAGE FORMING APPARATUS HAVING A CONFIGURATION TO PREVENT ELECTRIC DISCHARGE IN A CLEANING MEMBER

(75) Inventors: Katsumi Inukai, Aichi-ken (JP); Masahito Hamaya, Nagoya (JP); Tsuyoshi Maruyama, Nagoya (JP)

(73) Assignee: Brother Kogyo Kabushiki Kaisha, Nagoya-shi, Aich-ken (JP)

( * ) Notice: Subject to any disclaimer, the term of this patent is extended or adjusted under 35 U.S.C. 154(b) by 218 days.

(21) Appl. No.: 13/240,114

(22) Filed: Sep. 22, 2011

(65) Prior Publication Data

US 2012/0134699 A1 May 31, 2012

(30) Foreign Application Priority Data

Nov. 30, 2010 (JP) ..... 2010-267323

(51) Int. Cl.
*G03G 15/00* (2006.01)
*G03G 15/16* (2006.01)

(52) U.S. Cl.
CPC ..... *G03G 15/161* (2013.01); *G03G 2215/0141* (2013.01)
USPC ..... 399/71; 399/100

(58) Field of Classification Search
USPC ..... 399/71, 88, 90, 310
See application file for complete search history.

(56) References Cited

U.S. PATENT DOCUMENTS

| | | | | |
|---|---|---|---|---|
| 5,515,146 | A * | 5/1996 | Harasawa et al. | 399/310 |
| 5,600,405 | A | 2/1997 | Umeda et al. | |
| 2006/0171735 | A1 | 8/2006 | Hamada et al. | |
| 2007/0036578 | A1 | 2/2007 | Fukami et al. | |
| 2007/0059027 | A1 | 3/2007 | Ishikawa et al. | |
| 2007/0206970 | A1 | 9/2007 | Izumi et al. | |
| 2007/0286621 | A1 | 12/2007 | Nishikawa | |
| 2010/0034552 | A1 | 2/2010 | Maruyama et al. | |
| 2010/0124430 | A1 * | 5/2010 | Furukawa | 399/71 |
| 2010/0129108 | A1 | 5/2010 | Hayakawa et al. | |

FOREIGN PATENT DOCUMENTS

| | | | |
|---|---|---|---|
| JP | 561-114279 | A | 5/1986 |
| JP | H07-064444 | A | 3/1995 |
| JP | H07-287498 | A | 10/1995 |
| JP | 2004-198612 | A | 7/2004 |

(Continued)

OTHER PUBLICATIONS

Computer translation of JP2010-032979A; Feb. 12, 2010, to Hiroshi et al.*

(Continued)

*Primary Examiner* — Quana M Grainger
(74) *Attorney, Agent, or Firm* — Baker Botts L.L.P.

(57) ABSTRACT

An image forming apparatus is provided, which includes an image forming unit configured to form an image on a recording medium, a cleaned body that is an intended body to be cleaned, a cleaning member configured to clean at least attached matter, which is generated in image formation by the image forming unit, on the cleaned body, a backup member disposed to face the cleaning member across the cleaned body, a voltage supply unit configured to supply the backup member with a cleaning voltage having a polarity identical to a charge polarity of the attached matter, in an operation of cleaning the cleaned body, a detector configured to detect an electric quantity of the cleaning member when the cleaning voltage is supplied to the backup member by the voltage supply unit, and a controller configured to control the detected electric quantity of the cleaning member to be a predetermined value.

16 Claims, 7 Drawing Sheets

(56) References Cited

FOREIGN PATENT DOCUMENTS

Figure 1:
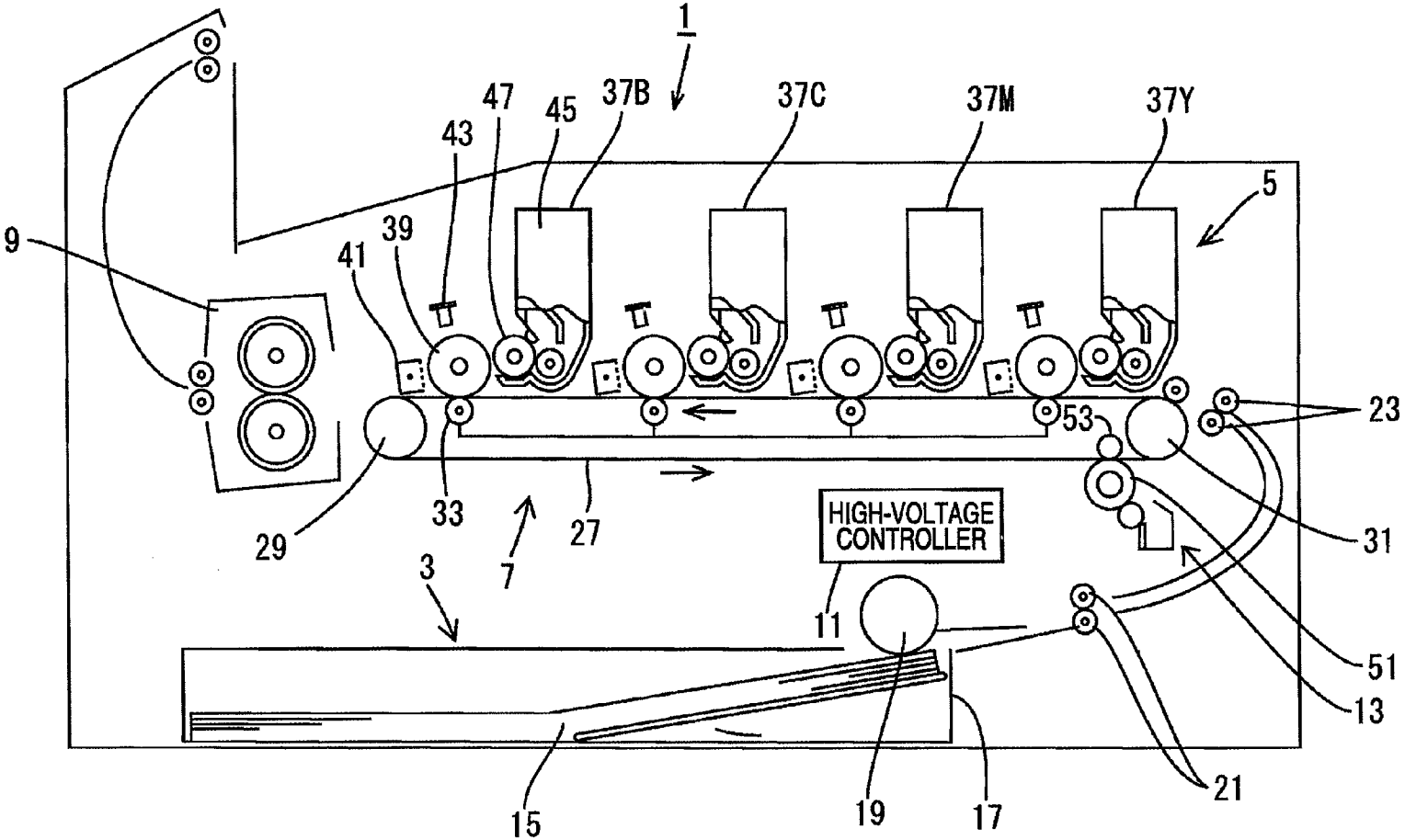

| | | | |
|---|---|---|---|
| JP | 2005-308894 | A | 11/2005 |
| JP | 2006-030554 | A | 2/2006 |
| JP | 2006-285202 | A | 10/2006 |
| JP | 2007-041348 | A | 2/2007 |
| JP | 2007-078803 | A | 3/2007 |
| JP | 2007-241285 | A | 9/2007 |
| JP | 2007-271880 | A | 10/2007 |
| JP | 2010-032979 | A | 2/2010 |
| JP | 2010-039452 | A | 2/2010 |
| JP | 2010-128052 | A | 6/2010 |

OTHER PUBLICATIONS

Japan Patent Office, Notification of Reasons for Rejection for Japanese Patent Application No. 2010-267323 (counterpart Japanese patent application), dispatched Apr. 9, 2013.

* cited by examiner

IMAGE FORMING APPARATUS HAVING A CONFIGURATION TO PREVENT ELECTRIC DISCHARGE IN A CLEANING MEMBER

CROSS-REFERENCE TO RELATED APPLICATION

This application claims priority under 35 U.S.C. §119 from Japanese Patent Application No. 2010-267323 filed on Nov. 30, 2010. The entire subject matter of the application is incorporated herein by reference.

BACKGROUND

1. Technical Field

The following description relates to one or more techniques to remove attached matter in an image forming apparatus.

2. Related Art

So far, as an example of techniques to remove attached matter in an image forming apparatus, a technique to remove unnecessary toner adhering onto a belt has been known. In this technique, so as to clean the belt, a cleaning member is provided, which includes a cleaning roller configured to contact the belt and a cleaning shaft configured to retrieve development agent attached to the cleaning roller. In order to perform belt cleaning electrically with the cleaning roller and the cleaning shaft, a negative high voltage (e.g., a negative voltage of −1600 V to −2000 V) is applied to the cleaning shaft. Additionally, the negative voltage, after being stepped down, e.g., to −1200 V to −1600 V, is applied to the cleaning roller.

SUMMARY

The aforementioned technique makes it possible to clean the belt in a favorable manner. However, in the technique, the cleaning member, which is configured with the cleaning roller and the cleaning shaft and disposed at an outer circumferential side of the belt, is required to be supplied with a high voltage. Therefore, for instance, there is a risk that electric discharge might be caused between a frame (in general, electrically connected to the ground) of the image forming apparatus for holding the cleaning member and an electricity supply member configured to supply electricity to the cleaning shaft. Occurrence of such electric discharge might lead to a lowered efficiency of cleaning.

Aspects of the present invention are advantageous to provide one or more improved techniques for an image forming apparatus, which techniques make it possible to restrain occurrence of electric discharge in a cleaning member.

According to aspects of the present invention, an image forming apparatus is provided, which includes an image forming unit configured to form an image on a recording medium, a cleaned body that is an intended body to be cleaned, a cleaning member configured to clean off at least attached matter, which is generated in image formation by the image forming unit, on the cleaned body, a backup member disposed to face the cleaning member across the cleaned body, a voltage supply unit configured to supply the backup member with a cleaning voltage having a polarity identical to a charge polarity of the attached matter, in an operation of cleaning the cleaned body, a detector configured to detect an electric quantity of the cleaning member when the cleaning voltage is supplied to the backup member by the voltage supply unit, and a controller configured to control the detected electric quantity of the cleaning member to be a predetermined value.

BRIEF DESCRIPTION OF THE ACCOMPANYING DRAWINGS

FIG. 1 is a cross-sectional side view schematically showing a configuration of a printer in a first embodiment according to one or more aspects of the present invention.

Figure 2:
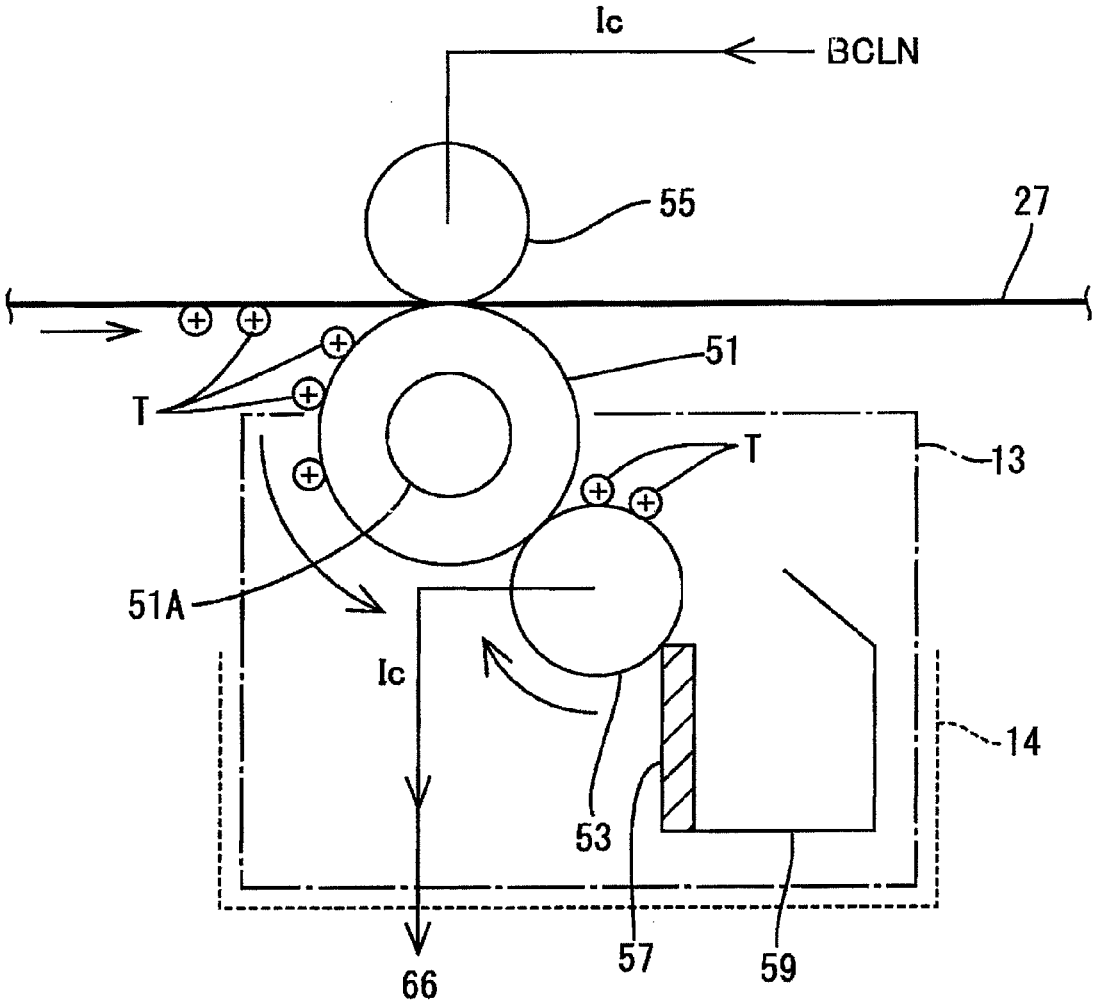

FIG. 2 schematically shows a configuration of a cleaning mechanism of the printer in the first embodiment according to one or more aspects of the present invention.

Figure 3:
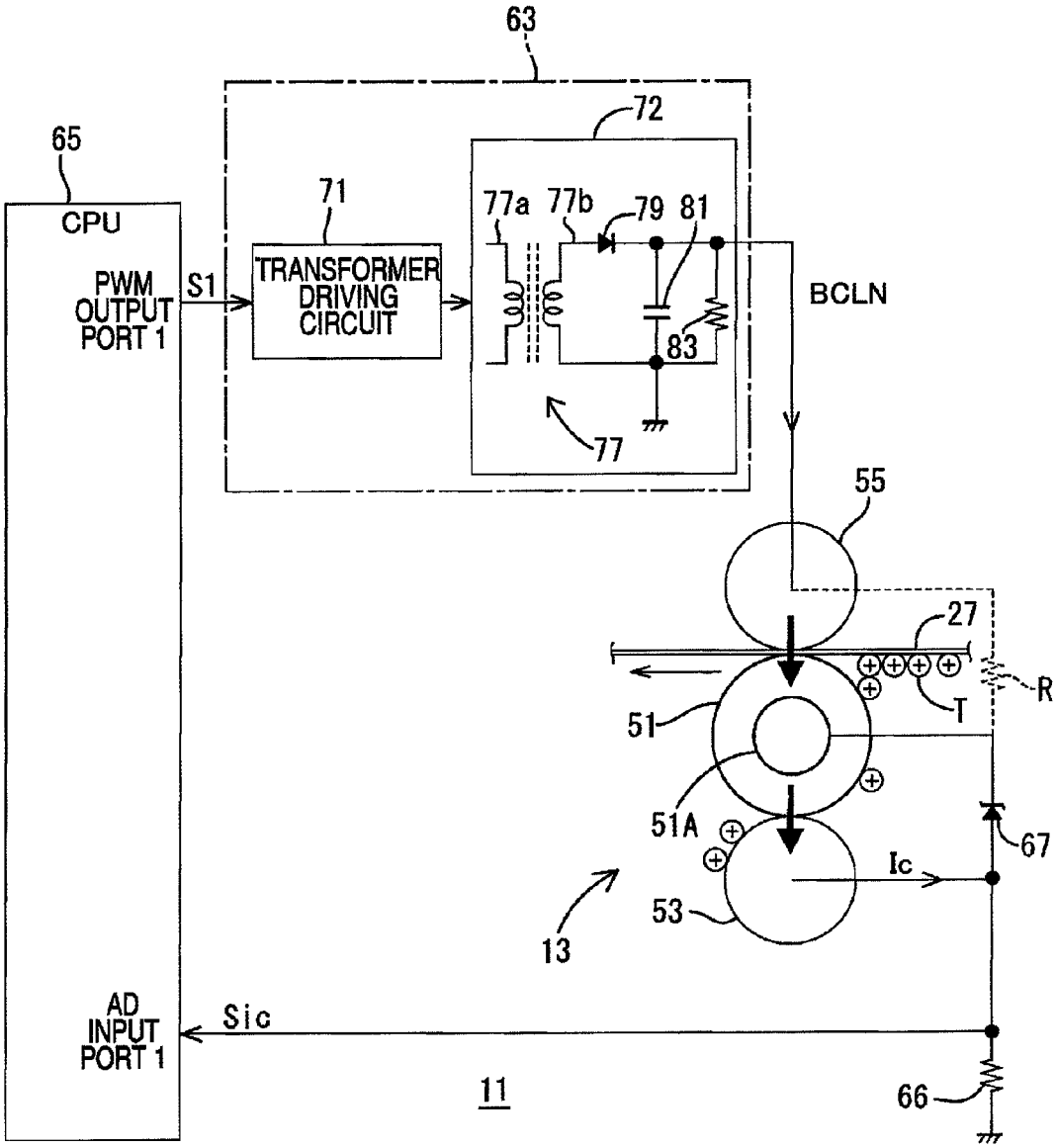

FIG. 3 schematically shows a configuration for generating a voltage to be applied to the cleaning mechanism in the first embodiment according to one or more aspects of the present invention.

Figure 4:
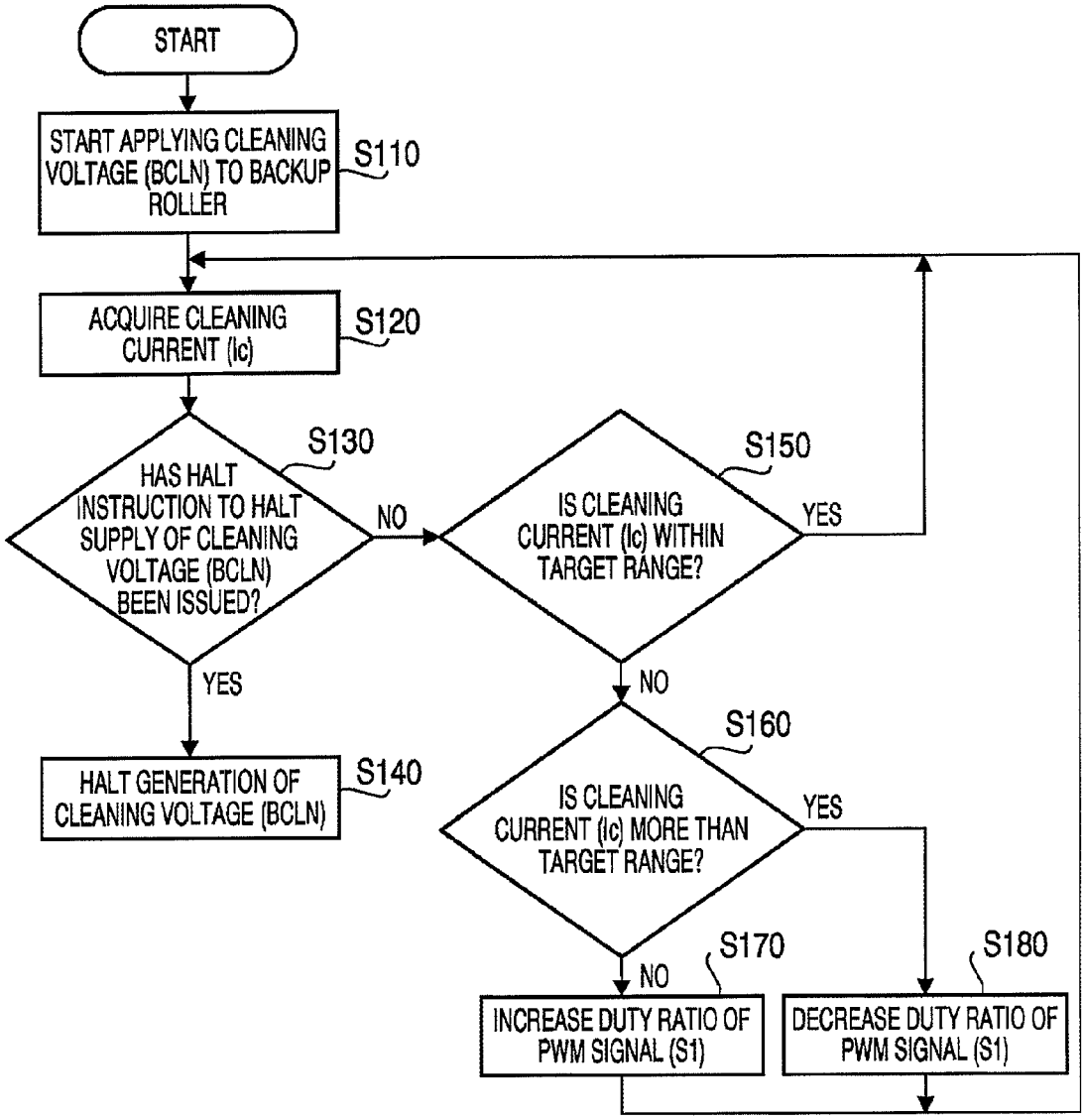

FIG. 4 is a flowchart showing a procedure of a cleaning process to be executed by a CPU of the printer in the first embodiment according to aspects of the present invention.

Figure 5:
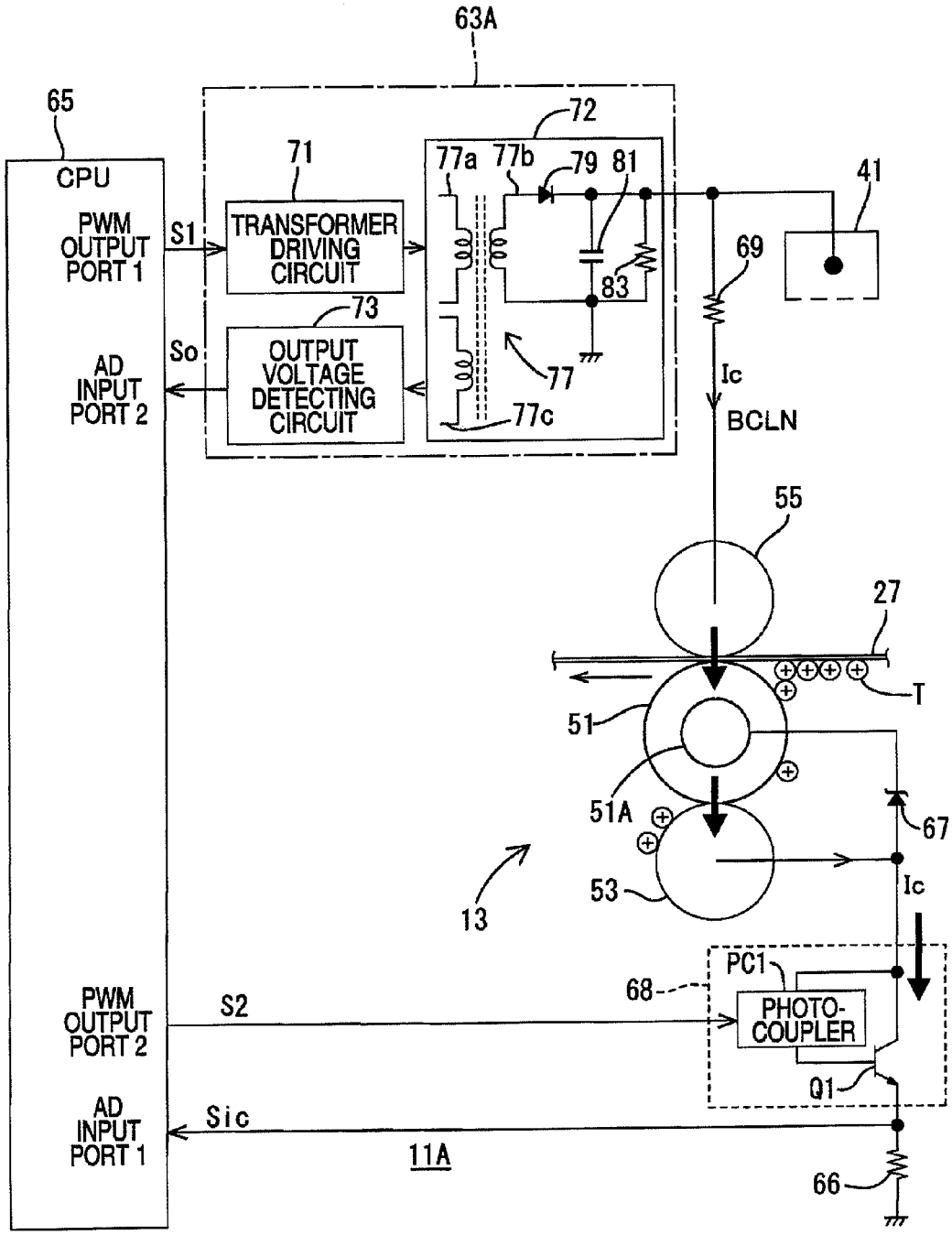

FIG. 5 schematically shows a configuration for generating a voltage to be applied to the cleaning mechanism in a second embodiment according to one or more aspects of the present invention.

Figure 6:
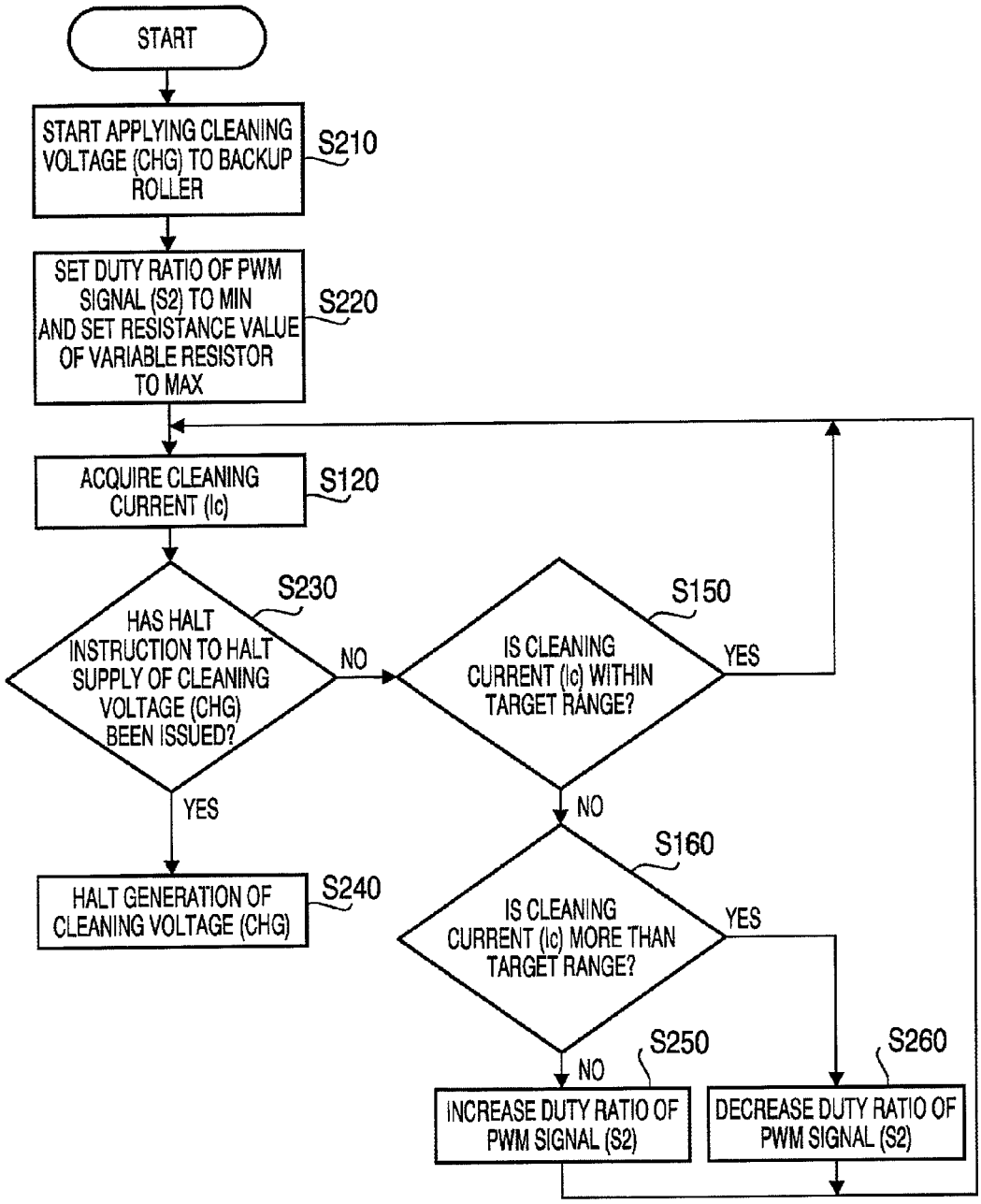

FIG. 6 is a flowchart showing a procedure of a cleaning process to be executed by the CPU of the printer in the second embodiment according to aspects of the present invention.

Figure 7:
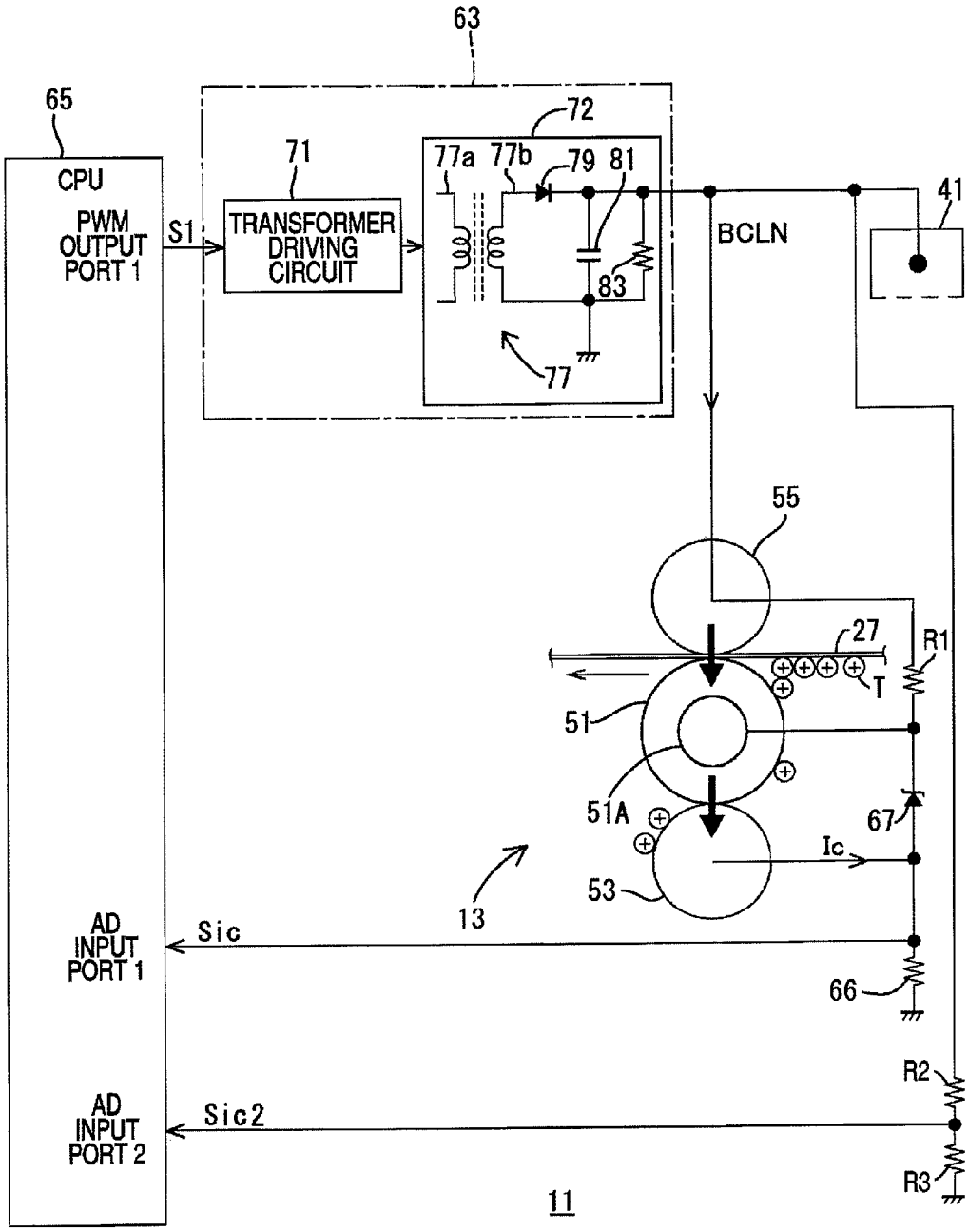

FIG. 7 schematically shows a configuration for generating a voltage to be applied to the cleaning mechanism in a modification according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the invention may be implemented in computer software as programs storable on computer-readable media including but not limited to RAMs, ROMs, flash memories, EEPROMs, CD-media, DVD-media, temporary storage, hard disk drives, floppy drives, permanent storage, and the like.

First Embodiment

Hereinafter, a first embodiment according to aspects of the present invention will be described with reference to FIGS. 1 to 4.

1. Overall Configuration of Printer

FIG. 1 is a cross-sectional side view schematically showing an internal configuration of a printer 1 of the first embodiment. In the following description, when each element included in the printer 1 is required to be discriminated with respect to toner color, one of Y (Yellow), M (Magenta), C (Cyan), and B (Black) is attached as a suffix to the reference number of the element. Meanwhile, when each element of the printer 1 is not required to be discriminated with respect to toner color, the reference number of the element is not accompanied by any suffix.

The printer 1 includes a sheet feeding unit 3, an image forming unit 5, a conveying mechanism 7, a fixing unit 9, and a high-voltage controller 11. The printer 1 is configured to form, on a sheet 15, a toner image with toner T of a plurality of colors (in the first embodiment, four colors of yellow, magenta, cyan, and black), for example, based on externally input image data. Further, the printer 1 includes a belt cleaning mechanism 13.

The sheet feeding unit 3 is disposed at the bottom of the printer 1 and provided with a tray 17 configured to accommodate sheets 15 and a pickup roller 19. The sheets 15 placed in the tray 17 are picked up by the pickup roller 19 on a sheet-by-sheet basis, and fed to the conveying mechanism 7 via feed rollers 21 and registration rollers 23.

The conveying mechanism 7 is configured to convey the sheets 15. In the conveying mechanism 7, a belt 27 is wound around a pair of a driving roller 29 and a driven roller 31. In response to rotation of the driving roller 29, an up-facing surface (facing photoconductive bodies 39) of the belt 27 travels from the right side to the left side in FIG. 1. Thereby, the sheet 15 fed by the registration rollers 23 is conveyed to below the image forming unit 5. Further, the conveying mechanism 7 includes four transfer rollers 33. Here, the belt 27 is an endless single-layered belt made of resin material such as thermoplastic elastomer. The electrical resistance of the belt 27 is approximately within a range of 10 MΩ to 1 GΩ.

The image forming unit 5 includes four development units 37Y, 37M, 37C, and 37B. Each development unit 37 includes a photoconductive body 39, an electrification device 41, an exposure device 43, and a unit case 45.

The photoconductive body 39 is configured, for instance, with a positively chargeable photoconductive layer formed on an aluminum substrate. The electrification device 41 is configured to positively charge a surface of the photoconductive body 39 (e.g., to +700 V).

The exposure device 43 includes a plurality of light emitting elements (e.g., LEDs) arranged linearly along a rotational axis direction of the photoconductive body 39. The exposure device 43 controls the light emitting elements to emit light, depending on one color of the externally input image data, so as to form an electrostatic latent image on a surface of the photoconductive body 39.

The unit case 45 is configured to accommodate a corresponding color of toner T (in the first embodiment, e.g., positively chargeable toner) and provided with development roller 47. The development roller 47 positively charges the toner T and supplies the positively charged toner T onto the photoconductive body 39 as an even thin layer. Thereby, the electrostatic latent image is developed, and the toner image is formed. It is noted that the toner T is positively-chargeable nonmagnetic-one-component toner.

Each transfer roller 33 is disposed in such a position as to pinch the belt 27 between the transfer roller 33 and the corresponding photoconductive body 39. Each transfer roller 33 is supplied with a negative voltage from a power supply (not shown) such that a transfer bias is applied between the transfer roller 33 and the corresponding photoconductive body 39 to transfer the toner image formed on the photoconductive body 39 onto the sheet 15. After that, the sheet 15 is conveyed by the conveying mechanism 7 to the fixing unit 9, where the toner image is thermally fixed. Thereafter, the sheet 15 is ejected onto an upper surface of the printer 1.

2. Configuration of Cleaning Mechanism

As depicted in FIG. 2, the cleaning mechanism 13 is disposed under the conveying mechanism 7, so as to remove attached matter on the belt 27. The attached matter, which is generated in image formation by the image forming unit 5, may contain toner T left on the belt 27 and fragments (paper powder) of sheets (the attached matter contains at least toner T). In the following description, an explanation will be provided with toner T as an example of the attached matter.

The cleaning mechanism 13 includes a cleaning roller 51, a retrieving roller 53, a backup roller 55, a cleaning blade 57, and a storage box 59. The cleaning mechanism 13 is supported by a predetermined frame 14.

The cleaning roller 51 is configured with a single silicon layer of foaming material provided around a metal shaft 51A extending in a width direction of the belt 27. The electrical resistance of the foaming material is approximately within a range of 100 kΩ to 1 GΩ.

The backup roller 55 is made of metal and disposed to face the cleaning roller 51 across the belt 27. Further, the backup roller 55 is supplied with a belt cleaning voltage BCLN that is a positive voltage and has the same polarity as the positively charged toner T. However, as far as the belt cleaning voltage BCLN has the same polarity as the charged toner T, the belt cleaning voltage BCLN does not necessarily have to be a positive voltage. In other words, when negatively charged toner is used, the belt cleaning voltage BCLN may be a negative voltage.

The cleaning roller 51 is driven to rotate in contact with the belt 27 in a direction that is opposite to a traveling direction of the belt 27 at a contact portion of the cleaning roller 51 with the belt 27. Then, for instance, when a belt cleaning voltage BCLN of 1600 V is applied to the backup roller 55, the toner T adhering onto the belt 27 is electrostatically attracted by and attached onto the cleaning roller 51, and a surface of the belt 27 is cleaned. It is noted that a voltage of the surface of the belt 27 that contacts the cleaning roller 51 is approximately 1 kV.

Further, the retrieving roller 53 is made of metal (for example, configured with a steel member coated with nickel plating or with a stainless member), and contacts the cleaning roller 51. A voltage of a portion of the retrieving roller 53 that contacts the cleaning roller 51 is approximately 0 V. Therefore, the toner T attached onto the cleaning roller 51 is electrostatically attracted by the retrieving roller 53. Thus, it is possible to retrieve the toner T.

The cleaning blade 57 is made, for instance, of rubber. Further, the cleaning blade 57 is configured to contact the retrieving roller 53 and scrape off the toner T attached onto the retrieving roller 53. Then, the scraped-off toner T is stored in the storage box 59.

3. Configuration of High-Voltage Controller

The high-voltage controller 11 is configured to generate a voltage to be applied to each electric load provided to the electrification device 41, the transfer roller 33, the development roller 47, and the cleaning mechanism 13.

FIG. 3 schematically shows a configuration of a section of the high-voltage controller 11 that generates a voltage to be applied to the cleaning mechanism 13. The high-voltage controller 11 includes a voltage supply circuit 63, a pulse width modulation (PWM) control circuit 65 that is configured, e.g., with a CPU, and a cleaning current detecting resistor 66. It is noted that the PWM control circuit 65 (hereinafter referred to as the "CPU 65") may be configured with an application specific integrated circuit (ASIC) or with separate circuits.

The voltage supply circuit 63 is configured to generate the belt cleaning voltage BCLN to be applied to the backup roller 55, and includes a transformer driving circuit 71 and a boosting ripple-filtering rectifier circuit 72.

The transformer driving circuit 71 is configured to, when receiving a PWM signal S1 from a PWM output port of the CPU 65, supply an oscillating current to a primary-side coil 77*a* of the boosting ripple-filtering rectifier circuit 72 based on the received PWM signal S1.

The boosting ripple-filtering rectifier circuit 72 includes a transformer 77, a diode 79, a ripple-filtering condenser 81. The transformer 77 includes the primary-side coil 77*a* and a secondary-side coil 77*b*. An end of the secondary-side coil 77*b* is electrically connected with the backup roller 55. Further, the ripple-filtering condenser 81 and a discharge resistor 83 are connected in parallel with the secondary-side coil 77*b*, respectively. With this configuration, an oscillating voltage of the primary-side coil 77*a* is rectified by the boosting ripple-filtering rectifier circuit 72 and applied to the backup roller 55 as the belt cleaning voltage BCLN (hereinafter, which may simply be referred to as the "cleaning voltage BCLN").

In addition, the cleaning current detecting resistor 66 (hereinafter, which may simply be referred to as the "current detecting resistor 66") is disposed between the cleaning mechanism 13 and the ground. The current detecting resistor 66 is configured to detect a cleaning current (electric quantity) Ic that is carried to the ground via the cleaning roller 51 and the retrieving roller 53 when the cleaning voltage BCLN is applied to the backup roller 55. In this case, the current detecting resistor 66 can detect, as the cleaning current Ic, only a current, excluding a current leaking to portions other than the belt 27, which is carried to the ground via the belt 27, the cleaning roller 51, and the retrieving roller 53 when the cleaning voltage BCLN is applied to the backup roller 55. In other words, the current detecting resistor 66 can detect, as the cleaning current Ic, only a current contributing to cleaning.

The CPU 65 takes constant-current control of the voltage supply circuit 63 so as to maintain a predetermined constant value of the cleaning current Ic, based on a detection signal Sic issued in response to the current detecting resistor 66 detecting the cleaning current Ic. Namely, the CPU 65 generates the PWM signal S1 and controls the cleaning voltage BCLN output from the voltage supply circuit 63 with the PWM signal S1, such that the cleaning current Ic is equal to the predetermined constant value.

The high-voltage controller 11 further includes a zener diode 67 for ensuring a predetermined electric potential difference between the cleaning roller 51 and the retrieving roller 53. The anode of the zener diode 67 is connected with the retrieving roller 53 and the current detecting resistor 66. The cathode of the zener diode 67 is connected with the shaft 51A of the cleaning roller 51. The zener diode 67 maintains the electric potential difference between the shaft 51A and the retrieving roller 53 to be a predetermined zener voltage Vz, e.g., 400 V.

Therefore, it is possible to ensure the electric potential difference between the cleaning roller 51 and the retrieving roller 53. Consequently, when the toner T on the belt 27 is removed in two steps as implemented in the first embodiment, it is possible to transfer the removed toner T from the cleaning roller 51 to the retrieving roller 53 in a favorable manner. Further, it is possible to prevent overvoltage between the cleaning roller 51 and the retrieving roller 53.

4. Belt Cleaning Process

Subsequently, referring to FIG. 4, an explanation will be provided about a belt cleaning process in the first embodiment, more specifically, about the constant-current control for regulating the cleaning current Ic within a predetermined range in a belt cleaning operation. FIG. 4 is a flowchart showing a procedure of the belt cleaning process to be executed by the CPU 65 in accordance with a predetermined program in the first embodiment.

For example, when the printer 1 is powered on, the CPU 65 boots the voltage supply circuit 63 to generate the cleaning voltage BCLN, and applies the cleaning voltage BCLN to the backup roller 55 (S110). Next, the CPU 65 acquires the cleaning current Ic based on the detection signal Sic of the current detecting resistor 66 (S120). Specifically, the CPU 65 acquires the cleaning current Ic by dividing the detection signal (voltage value) Sic by a resistance value of the current detecting resistor 66.

Subsequently, the CPU 65 determines whether a halt instruction to halt supply of the cleaning voltage BCLN has been issued, namely, whether a halt instruction to halt the cleaning operation has been issued (S130). The halt instruction is issued, for example, when a predetermined time period has elapsed since the start of the cleaning operation. When determining that the halt instruction has been issued (S130: Yes), the CPU 65 controls the voltage supply circuit 63 to halt generation of the cleaning voltage BCLN (S140).

Meanwhile, when determining that the halt instruction has not been issued (S130: No), the CPU 65 determines whether (the value of) the cleaning current Ic is within a target range (S150). When determining that the cleaning current Ic is within the target range (S150: Yes), the CPU 65 goes back to S120. Meanwhile, when determining that the cleaning current Ic is not within the target range (S150: No), the CPU 65 determines whether the cleaning current Ic is more than the target range (S160).

When determining that (the value of) the cleaning current Ic is not more than the target range, namely, that (the value of) the cleaning current Ic is less than the minimum value of the target range (S160: No), the CPU 65 increases a duty ratio of the PWM signal S1 by a predetermined value (S170). Meanwhile, when determining that the cleaning current Ic is more than the target range, namely, that the cleaning current Ic is more than the maximum value of the target range (S160: Yes), the CPU 65 decreases the duty ratio of the PWM signal S1 by a predetermined value (S180).

Thus, in the first embodiment, by controlling the duty ratio of the PWM signal 51, the cleaning current Ic is regulated (under constant-current control) within the predetermined range. Therefore, when the predetermined range is appropriately set as needed, it is possible to easily control the amount of the toner T transferred to the cleaning mechanism 13. Consequently, it is possible to easily maintain an adequate level of cleaning performance of the cleaning mechanism 13.

5. Effects of First Embodiment

When the belt 27 is cleaned, the cleaning voltage BCLN with the same polarity as the charged toner T is supplied from the backup roller 55. Therefore, it is possible to reduce the level of the cleaning voltage BCLN to be applied to the cleaning roller 51 and the retrieving roller 53. Thus, it is possible to prevent occurrence of discharge from the cleaning mechanism 13 to the frame 14 in a favorable manner.

Second Embodiment

Subsequently, a second embodiment according to aspects of the present invention will be described with reference to FIGS. 5 and 6. It is noted that, in the following description, only specific features of the second embodiment different from the first embodiment will be set forth. Regarding elements of the second embodiment with the same configurations as the first embodiment, the same reference characters will be attached thereto and explanation about them will be omitted.

6. Configuration of Second Embodiment

As illustrated in FIG. 5, the second embodiment is different from the first embodiment mainly in that the cleaning voltage BCLN is generated with a charge voltage CHG. In the second embodiment, the cleaning voltage BCLN is generated with the charge voltage CHG being divided by a voltage dividing resistor 69.

Namely, in the second embodiment, a charge voltage supply circuit 63A, which is configured to apply to an electrification device 41 the positive charge voltage CHG having the same polarity as the charged toner T, corresponds to the voltage supply circuit 63 of the first embodiment.

A transformer 77 of the charge voltage supply circuit 63A includes a primary-side auxiliary coil 77*c* configured to generate a voltage corresponding to the charge voltage CHG. Further, the charge voltage supply circuit 63A includes an output voltage detecting circuit 73 configured to detect the charge voltage CHG based on the voltage generated by the primary-side auxiliary coil 77*c*. The CPU 65 controls the charge voltage supply circuit 63A to generate the charge voltage CHG based on a detection voltage value (i.e., an output detection signal) So issued by the output voltage detecting circuit 73. Specifically, the CPU 65 controls generation of the charge voltage CHG while changing a duty ratio of the PWM signal S1 based on the output detection signal So.

Further, a high-voltage controller 11A of the second embodiment includes a variable resistor 68 on a current path of the cleaning current Ic that is carried between the backup roller 55 and the cleaning members (i.e., the cleaning roller 51 and the retrieving roller 53). Specifically, the variable resistor 68 is configured with a photo-coupler PC1 and a transistor Q1 and connected between the retrieving roller 53 and the current detecting resistor 66. It is noted that the configuration of the variable resistor 68 is not limited to that as described above. For instance, the variable resistor 68 may be a digital variable resistor (a digital potentiometer).

Here, when the base current of the transistor Q1 is varied by the photo-coupler PC1, the resistance between the collector and the emitter is varied. At that time, the CPU 65 controls the photo-coupler PC1 with the PWM signal S2 to vary a resistance value of the variable resistor 68 and adjust the cleaning current Ic. Thus, owing to the variable resistor 68 being provided, it is possible to appropriately adjust the charge voltage CHG from the charge voltage supply circuit 63A to generate the cleaning voltage BCLN or the cleaning current Ic suitable for cleaning.

Specifically, the CPU 65 adjusts the cleaning current Ic by controlling the variable resistor 68 to increase the resistance value thereof in response to increase of the charge voltage CHG and to decrease the resistance value thereof in response to decrease of the charge voltage CHG. More specifically, the CPU 65 changes the duty ratio of the PWM signal S2 based on the current detection signal Sic input to the AD input port 1 to vary the resistance of the variable resistor 68.

Namely, by controlling the variable resistor 68 based on the detected cleaning current Ic, the CPU 65 takes feedback control of the cleaning current Ic so as to maintain a predetermined value of the cleaning current Ic.

7. Belt Cleaning Process in Second Embodiment

Subsequently, referring to FIG. 6, a belt cleaning process of the second embodiment will be described. FIG. 6 is a flowchart showing a procedure of the belt cleaning process in the second embodiment. The belt cleaning process is executed by the CPU 65 in accordance with a predetermined program in the same manner as the first embodiment. It is noted that the same operations as those of the first embodiment will be provided with the same reference characters as those shown in FIG. 4, and explanations about the same operations will be omitted.

For example, when the printer 1 is powered on, the CPU 65 boots the charge voltage supply circuit 63A to generate the charge voltage CHG, and supplies the backup roller 55 with the cleaning voltage BCLN generated with the charge voltage CHG being divided by the voltage dividing resistor 69 (S210). At that time, for instance, the CPU 65 sets the duty ratio of the PWM signal S2 to the minimum value and sets the resistance value of the variable resistor 68 to the maximum value (S220).

Next, when determining that a halt instruction to halt supply of the cleaning voltage BCLN has been issued (S230: Yes), the CPU 65 controls the charge voltage supply circuit 63A to halt generation of the charge voltage CHG and the cleaning voltage BCLN (S240).

Meanwhile, in the case where the CPU 65 determines that a halt instruction to halt supply of the cleaning voltage BCLN has not been issued (S230: No), when determining that the cleaning current Ic is not within a target range (S150: No) or more than the target range (S160: No), namely, that the cleaning current Ic is less than the minimum value of the target range, the CPU 65 increases the duty ratio of the PWM signal S2 by a predetermined value (S250). Meanwhile, when determining that the cleaning current Ic is not within a target range (S150: No) and more than the target range (S160: Yes), namely, that the cleaning current Ic is more than the maximum value of the target range, the CPU 65 decreases the duty ratio of the PWM signal S2 by a predetermined value (S260).

Thus, in the second embodiment, even though the charge voltage CHG is controlled to be a predetermined constant voltage, the duty ratio of the PWM signal S2 is controlled such that the cleaning current Ic is regulated (under constant-current control) within a predetermined range. Therefore, when the predetermined range is set appropriately as needed, it is possible to easily control the amount of the toner T transferred to the cleaning mechanism 13. Consequently, it is possible to maintain a predetermined level of cleaning performance of the cleaning mechanism 13.

8. Effects of Second Embodiment

The cleaning voltage BCLN is generated from the charge voltage CHG generated by the charge voltage supply circuit 63A. Therefore, there is no need to separately provide a specific supply circuit for applying the cleaning voltage BCLN to the cleaning mechanism 13. Namely, it is possible to simplify the configuration for cleaning the belt 27 and thereby to simplify the configuration of the printer 1.

At that time, even though the charge voltage CHG is controlled to be a predetermined constant voltage, the variable resistor 68 is controlled such that the cleaning current Ic is regulated within a predetermined current range. Therefore, it is possible to maintain a predetermined level of cleaning performance of the cleaning mechanism 13.

Based on the detected charge voltage CHG and cleaning current Ic, the CPU 65 calculates a resistance Rbs between the backup roller 55 and the retrieving roller 53. Then, the CPU 65 may adjust the cleaning current Ic by controlling the variable resistor 68 to decrease the resistance value thereof in response to increase of the resistance Rbs and to increase the resistance value thereof in response to decrease of the resistance Rbs.

At that time, for instance, the CPU 65 calculates the resistance Rbs with the value of the variable resistor 68 equivalent to approximately zero. The resistance Rbs is determined with the following expression:

$$Rbs=CHG/Ic-R66-R69,$$

where R66 represents the resistance value of the current detecting resistor 66, and R69 represents the resistance value of the voltage dividing resistor 69. In this case, even when the resistance value Rbs varies depending on circumstances, it is possible to restrain variation of the cleaning current Ic.

Further, with the charge voltage CHG generated by the charge voltage supply circuit 63A, the operations of charging the photoconductive body 39 and cleaning the belt 27 may concurrently be performed. Alternatively, the operations of charging the photoconductive body 39 and cleaning the belt 27 may be performed separately at respective different moments with a specific configuration provided therefor.

Further, the voltage detecting circuit 73 does not necessarily have to be provided. In other words, the aforementioned control to detect the charge voltage CHG and vary the variable resistor 68 in response to a change in the detected charge voltage CHG may be omitted. What matters is that at least the cleaning voltage BCLN is generated with the charge voltage CHG.

Hereinabove, the embodiments according to aspects of the present invention have been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only exemplary embodiments of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications may be practicable.

MODIFICATIONS

In each of the aforementioned embodiments, the cleaning mechanism 13 is configured with the cleaning roller 51 and the retrieving roller 53, such that the toner T on the belt 27 is removed in two steps. However, the cleaning mechanism 13 may be configured with a single member.

As shown in FIG. 7, a resistor R1 connected in parallel with the backup roller 55 and the cleaning roller 51 and a voltage detector for detecting a voltage supplied to the backup roller 55 may be provided. Further, for example, the voltage detector may be configured to detect the voltage of a signal Sic2, which is generated with the cleaning voltage BCLN being divided by voltage dividing resistors R2 and R3 and then input into the AD input port 2. Moreover, the CPU 65 may take constant-voltage control of the voltage supply circuit 63 so as to hold constant the voltage (the voltage division) Sic2 detected by the voltage detector. Thus, by providing the resistor R1 connected in parallel with the backup roller 55 and the cleaning roller 51, it is possible to increase the cleaning current Ic while keeping constant the electric potential difference between the backup roller 55 and the cleaning roller 51 and to ensure a large electric potential difference between the cleaning roller 51 and the retrieving roller 53. Thereby, it is possible to ensure a large electrostatic force for transferring the toner T from the cleaning roller 51 to the retrieving roller 53.

In each of the aforementioned embodiments, the belt 27 is exemplified as a body to be cleaned. However, aspects of the present invention may be applied to a configuration with each photoconductive body 39 as a body to be cleaned. In this case, a central axis of the photoconductive body 39 may be a backup member to be supplied with a cleaning voltage.

What is claimed is:

1. An image forming apparatus comprising:

an image forming unit configured to form an image on a recording medium;

a cleaned body that is an intended body to be cleaned;

a cleaning member configured to clean off at least attached matter, which is generated in image formation by the image forming unit, on the cleaned body;

a backup member disposed to face the cleaning member across the cleaned body;

a voltage supply unit configured to supply the backup member with a cleaning voltage having a polarity identical to a charge polarity of the attached matter, in an operation of cleaning the cleaned body;

a transistor disposed on an electric path of a cleaning current carried through the backup member and the cleaning member;

a current detector configured to detect the cleaning current carried through the backup member and the cleaning member when the cleaning voltage is supplied to the backup member by the voltage supply unit; and a controller configured to control the transistor to hold the cleaning current constant.

2. The image forming apparatus according to claim 1, wherein the current detector is disposed between the cleaning member and a ground.

3. An image forming apparatus comprising:

an image forming unit configured to form an image on a recording medium;

a cleaned body that is an intended body to be cleaned;

a cleaning member configured to clean off at least attached matter, which is generated in image formation by the image forming unit, on the cleaned body;

a backup member disposed to face the cleaning member across the cleaned body;

a voltage supply unit configured to supply the backup member with a cleaning voltage having a polarity identical to a charge polarity of the attached matter, in an operation of cleaning the cleaned body;

a detector configured to detect an electric quantity of the cleaning member when the cleaning voltage is supplied to the backup member by the voltage supply unit;

a controller configured to control the detected electric quantity of the cleaning member to be a predetermined value;

a photoconductive body;

an electrification device configured to charge the photoconductive body; and a variable resistor disposed on an electric path of a cleaning current carried between the backup member and the cleaning member, wherein the voltage supply unit comprises a charge voltage supplier configured to supply the electrification device with a charge voltage having a polarity identical to the charge polarity of the attached matter, wherein the voltage supply unit generates the cleaning voltage with the charge voltage supplied from the charge voltage supplier, and wherein the controller controls the variable resistor to adjust the cleaning current.

4. The image forming apparatus according to claim 3, further comprising a voltage detector configured to detect the charge voltage to be supplied to the electrification device, wherein the controller controls generation of the charge voltage by the charge voltage supplier based on a value of the charge voltage detected by the voltage detector, and wherein the controller adjusts the cleaning current by controlling the variable resistor to increase a resistance value of the variable resistor in response to increase of the charge voltage and to decrease the resistance value of the variable resistor in response to decrease of the charge voltage.

5. The image forming apparatus according to claim 3, wherein the detector comprises a current detector configured to detect the cleaning current as the electric quantity of the cleaning member, and wherein the controller takes feedback control of the cleaning current so as to maintain a predetermined value of the cleaning current, by controlling the variable resistor based on a value of the cleaning current detected by the current detector.

6. The image forming apparatus according to claim 3, further comprising a voltage detector configured to detect the charge voltage, wherein the detector comprises a current detector configured to detect the cleaning current as the electric quantity of the cleaning member, wherein the controller calculates a resistance between the backup member and the cleaning member based on a value of the charge voltage detected by the voltage detector and a value of the cleaning current detected by the current detector, and wherein the controller adjusts the cleaning current by controlling the variable resistor to decrease a resistance value of the variable resistor in response to increase of the resistance and to increase the resistance value of the variable resistor in response to decrease of the resistance.

7. The image forming apparatus according to claim 1, wherein the cleaning member comprises:

a first cleaning section disposed to face the backup member across the cleaned body, the first cleaning section being configured to clean off the attached matter on the cleaned body; and a second cleaning section configured to clean off the attached matter on the first cleaning section.

8. The image forming apparatus according to claim 7, further comprising a constant-potential section configured to ensure a predetermined electric potential difference between the first cleaning section and the second cleaning section.

9. An image forming apparatus comprising:

an image forming unit configured to form an image on a recording medium;

a cleaned body that is an intended body to be cleaned;

a cleaning member configured to clean off at least attached matter, which is generated in image formation by the image forming unit, on the cleaned body;

a backup member disposed to face the cleaning member across the cleaned body;

a voltage supply unit configured to supply the backup member with a cleaning voltage having a polarity identical to a charge polarity of the attached matter, in an operation of cleaning the cleaned body;

a detector configured to detect an electric quantity of the cleaning member when the cleaning voltage is supplied to the backup member by the voltage supply unit; and a controller configured to control the detected electric quantity of the cleaning member to be a predetermined value, wherein the cleaning member comprises:

a first cleaning section configured to clean off the attached matter on the cleaned body; and a second cleaning section configured to clean off the attached matter on the first cleaning section, wherein the image forming apparatus further comprises:

a constant-potential section configured to ensure a predetermined electric potential difference between the first cleaning section and the second cleaning section; and a resistor connected between the constant-potential section and an electricity supply line for supplying electricity from the voltage supply unit to the backup member, wherein the detector comprises a voltage detector configured to detect a voltage supplied to the backup member as the electric quantity, and wherein the controller controls the voltage supply unit so as to hold constant the voltage supplied to the backup member, based on a value of the voltage detected by the voltage detector.

10. The image forming apparatus according to claim 1, wherein the cleaned body is a belt configured to convey the recording medium in the image formation by the image forming unit, and wherein the attached matter includes at least development agent used for the image formation by the image forming unit.

11. The image forming apparatus according to claim 3, wherein the cleaning member comprises:

a first cleaning section disposed to face the backup member across the cleaned body, the first cleaning section being configured to clean off the attached matter on the cleaned body; and a second cleaning section configured to clean off the attached matter on the first cleaning section.

12. The image forming apparatus according to claim 11, further comprising a constant-potential section configured to ensure a predetermined electric potential difference between the first cleaning section and the second cleaning section.

13. The image forming apparatus according to claim 3, wherein the cleaned body is a belt configured to convey the recording medium in the image formation by the image forming unit, and wherein the attached matter includes at least development agent used for the image formation by the image forming unit.

14. The image forming apparatus according to claim 9, wherein the cleaning member comprises:

a first cleaning section disposed to face the backup member across the cleaned body, the first cleaning section being configured to clean off the attached matter on the cleaned body; and a second cleaning section configured to clean off the attached matter on the first cleaning section.

15. The image forming apparatus according to claim 14, further comprising a constant-potential section configured to ensure a predetermined electric potential difference between the first cleaning section and the second cleaning section.

16. The image forming apparatus according to claim 9, wherein the cleaned body is a belt configured to convey the recording medium in the image formation by the image forming unit, and wherein the attached matter includes at least development agent used for the image formation by the image forming unit.

* * * * *

UNITED STATES PATENT AND TRADEMARK OFFICE

CERTIFICATE OF CORRECTION

PATENT NO. : 8,792,798 B2
APPLICATION NO. : 13/240114
DATED : July 29, 2014
INVENTOR(S) : Katsumi Inukai et al.

It is certified that error appears in the above-identified patent and that said Letters Patent is hereby corrected as shown below:

Title Page, Item (56), Line 18:

Please change "JP 561-114279 A" to --JP S61-114279 A--.

Signed and Sealed this
Ninth Day of December, 2014

Michelle K. Lee

Michelle K. Lee
*Deputy Director of the United States Patent and Trademark Office*